US011168862B2

(12) United States Patent
Crompvoets et al.

(10) Patent No.: US 11,168,862 B2
(45) Date of Patent: Nov. 9, 2021

(54) FLEXIBLE LED LIGHTING STRIP WITH SLANTED LEDS

(71) Applicant: Lumileds Holding B.V., Schiphol (NL)

(72) Inventors: Floris Maria Hermansz Crompvoets, Bunde (NL); Christian Kleijnen, Ell (NL)

(73) Assignee: LUMILEDS LLC, San Jose, CA (US)

( * ) Notice: Subject to any disclaimer, the term of this patent is extended or adjusted under 35 U.S.C. 154(b) by 0 days.

(21) Appl. No.: 16/393,605

(22) Filed: Apr. 24, 2019

(65) Prior Publication Data

US 2019/0331311 A1 Oct. 31, 2019

(30) Foreign Application Priority Data

Apr. 26, 2018 (EP) ..... 18169520

(51) Int. Cl.
*F21S 43/15* (2018.01)
*F21S 43/14* (2018.01)
(Continued)

(52) U.S. Cl.
CPC ..... *F21S 43/15* (2018.01); *F21S 4/24* (2016.01); *F21S 43/14* (2018.01); *F21S 43/195* (2018.01);
(Continued)

(58) Field of Classification Search
CPC ..... F21S 43/15; F21S 4/24; F21Y 2103/30; F21Y 2107/50
See application file for complete search history.

(56) References Cited

U.S. PATENT DOCUMENTS

2009/0296382 A1 12/2009 Maier
2011/0228536 A1* 9/2011 Im ..... F21S 41/192 362/249.06
(Continued)

FOREIGN PATENT DOCUMENTS

DE 202005018416 U1 2/2006
WO 2005/027598 A1 3/2005
WO 2015/175794 A1 11/2015

OTHER PUBLICATIONS

International Preliminary Report on Patentability dated Oct. 27, 2020 for PCT International Application No. PCT/EP2019/060090.
(Continued)

*Primary Examiner* — Joseph L Williams
(74) *Attorney, Agent, or Firm* — Volpe Koenig

(57) ABSTRACT

The invention describes a flexible lighting strip for use in a vehicle signaling light. The flexible lighting strip comprises a multitude of light-emitting diodes. The flexible lighting strip is arranged to be bended around at least two, more preferably three linear independent axes. Light-emitting diodes of at least a first group of the light-emitting diodes are inclined with respect to a longitudinal extension of the flexible lighting strip such that surface normals of light exit surfaces of the first group of the light-emitting diodes enclose a first angle of more than 0° with corresponding surface normals of a light emission surface of the flexible lighting strip. The invention further relates to a light assembly comprising such a flexible lighting strip. The invention finally relates to a vehicle signaling light comprising such a vehicle light assembly.

13 Claims, 5 Drawing Sheets

(51) Int. Cl.

| | |
|---|---|
| ***F21S 43/19*** | (2018.01) |
| ***F21S 4/24*** | (2016.01) |
| *F21Y 103/30* | (2016.01) |
| *F21Y 103/10* | (2016.01) |
| *F21Y 115/10* | (2016.01) |
| *F21Y 107/50* | (2016.01) |

(52) U.S. Cl.
CPC ..... *F21Y 2103/10* (2016.08); *F21Y 2103/30* (2016.08); *F21Y 2107/50* (2016.08); *F21Y 2115/10* (2016.08)

(56) References Cited

U.S. PATENT DOCUMENTS

| | | | | |
|---|---|---|---|---|
| 2013/0329444 | A1 | 12/2013 | Oh | |
| 2015/0003083 | A1* | 1/2015 | Uehara | F21S 43/15 362/418 |
| 2015/0069442 | A1* | 3/2015 | Liu | H01L 33/504 257/98 |
| 2016/0178151 | A1 | 6/2016 | Maitre | |
| 2017/0045190 | A1* | 2/2017 | Song | F21S 41/151 |
| 2017/0138557 | A1* | 5/2017 | Henige | F21S 43/26 |

OTHER PUBLICATIONS

European Search Report dated Oct. 16, 2018 for European Patent Application No. 18169520.

* cited by examiner

FLEXIBLE LED LIGHTING STRIP WITH SLANTED LEDS

FIELD OF INVENTION

The invention relates to a flexible lighting strip comprising a multitude of slanted light-emitting diodes (LEDs) in a longitudinal arrangement. The invention further relates to a light assembly comprising such a flexible lighting strip. The invention finally relates to a vehicle signaling light comprising such a vehicle light assembly.

BACKGROUND

Flexible LED bands are used for an ever-increasing number of lighting applications. In many cases, an optical element is arranged in front of an LED to alter the light emission, such as e.g. a lens, a reflector and/or a collimator and/or light guide to obtain an emitted light beam of desired properties. Bendability or conformability of the LED band allows fitting in a corresponding application as, for example, vehicle light assemblies which are integrated in curvy automobile body frames.

US 2009/0296382 A1 discloses, for example, a flexible LED band. The flexible LED band has a basis for attaching the flexible LED band and at least partially light-transmissive covering connectable to the basis, wherein in a state connected to each other the basis and the covering form an accommodation cavity for the flexible LED band.

US 2013/0329444 A1 discloses a lamp device including a surface light source and a vehicle lamp apparatus. The lamp device may include a substrate including a plurality of supporting portions each having a light source mounted thereon, and connecting portions disposed between neighboring supporting portions.

SUMMARY

It is an object of the present invention to provide a flexible lighting strip comprising a multitude of slanted LEDs with improved light emission.

The invention is defined by the independent claims. The dependent claims define advantageous embodiments.

According to a first aspect a flexible lighting strip comprising a multitude of slanted light-emitting diodes (LEDs) is provided. The flexible lighting strip is adapted or arranged for use in a vehicle signaling light. The flexible lighting strip is arranged to be bended around at least two, more preferably three linear independent axes. LEDs of at least a first group of the LEDs are inclined with respect to a longitudinal extension of the flexible lighting strip such that surface normals of light exit surfaces of the first group of the LEDs enclose a first angle of more than 0° with corresponding surface normals of a light emission surface of the flexible lighting strip.

LEDs are basically Lambertian emitters, i.e. they do not have any collimating or beam directing optics attached. Using LEDs in flexible LED bands makes geometrical optical design not easy to implement, especially in the small build height of the flexible LED bands. Some applications may require strong bending of the flexible LED band. Implementing a standard flexible LED band, for example, in a vehicle signaling light like a strongly curved Daylight Running Light (DRL) will cause a lot of light going sideways because of the Lambertian emission characteristic of the LEDs. The main emission direction of the LEDs with Lambertian emission characteristic usually coincides with the surface normals of the light exit surfaces of the LEDs. A surface normal of one LED points in the prior art solutions as described above essentially in the same direction as a corresponding (local) surface normal of a part of light emission surface directly arranged above the LED. The maximum light emission of the flexible LED band therefore essentially coincides with the surface normal of the light emission surface above the respective LED. This has the effect that the main emission direction follows a curvature of the light emission surface of the flexible LED band. However, several regulations (e.g. ECE R87 for DRL) require that most of the light must be emitted in a predefined direction (e.g. forward direction for a vehicle front light or backwards direction for a vehicle back light).

The flexible lighting strip described above with at least a first group of LEDs which are inclined with respect to a longitudinal extension of the flexible lighting strip does avoid the disadvantage by directing the light emitted by the LEDs in a different direction than the surface normal of the light emission surface of the flexible lighting strip. The flexible lighting strip is usually straight in the basic configuration (e.g. before integration in a vehicle signaling light). The main emission direction of the LEDs corresponds with the surface normal of the light exit surface of each LED. The surface normal of the LEDs of the first group is inclined with respect to the light emission surface of the flexible lighting strip. The main emission direction of the LED (taking a Lambertian light distribution of the emitted LED light) is therefore slanted or inclined with respect to the surface normal of the light emission surface of the flexible lighting strip before bending the flexible lighting strip. This feature is essentially preserved during bending of the flexible lighting strip such that the main emission direction of light emitted by one LED in a bended or curved segment of the flexible lighting strip is inclined with respect to the local surface normal of a surface element of the light emission surface of the flexible lighting strip arranged directly above the light exit surface of the LED. The angle of inclination therefore enables to weight the main emission direction depending on the application such that more light is directed in a predefined direction (e.g. forward or backward direction) essentially independent from the direction of the surface normal of the light emission surface of the flexible lighting strip.

The first group of LEDs may comprise one, two, three, four or more LEDs. The angle of inclination and the distance between neighboring LEDs may be arranged such that shadowing effects are essentially avoided. The distance between neighboring LEDs may further be adapted to the curvature of the flexible lighting strip in the application.

The flexible lighting strip may comprise at least a second group of the LEDs. The LEDs of the second group of the LEDs are inclined with respect to the longitudinal extension of the flexible lighting strip such that the surface normals of light exit surfaces of the second group of the LEDs enclose a second angle of more than 0° with the corresponding surface normals of the light emission surface of the flexible lighting strip. The second angle is different than the first angle.

The flexible lighting strip may especially comprise at least three groups of the LEDs. The LEDs of the at least three groups are inclined with respect to the longitudinal extension of the flexible lighting strip such that the surface normals of light exit surfaces of the at least three groups of the LEDs enclose different angles of more than 0° with the corresponding surface normals of the light emission surface of the flexible lighting strip. The angles change along a longitudinal extension of the flexible lighting strip.

Using two, three, four or more groups of LEDs enables adaption of the inclination of the LEDs with respect to an intended curvature or bending of the flexible lighting strip in order to direct as much light as possible in a predefined direction in the final application. The angle of inclination may, for example, increase for each LED from a first side of the flexible lighting strip to a second side to compensate for an increasing curvature starting from the first side to the second side of the flexible lighting strip.

The light-emitting diodes are mounted on a carrier structure. The carrier structure is arranged to incline the light-emitting diodes with respect to the light emission surface of the flexible lighting strip. The LEDs are in this embodiment mounted on the carrier structure. The carrier structure may therefore enable a simplified adaption of the angle of inclination to the intended application. The carrier structure may, for example, comprise carrier elements and connection elements in an alternating arrangement. The carrier elements are inclined with respect to the connection elements. The LEDs may in this embodiment either be mounted on a submount attached to the carrier element or may be directly mounted on the carrier elements. The connection elements may be arranged to provide a mechanical or electrical coupling between carrier elements and between the LEDs.

The carrier elements and the connection elements may be arranged in a saw tooth arrangement.

The carrier structure is arranged such that the angles between the corresponding surface normal of a light exit surface of a first light-emitting diode and the corresponding surface normal of a first part of the light emission surface associated with the first light-emitting diode increases with increasing curvature of the first part of the light emission surface. The carrier structure may enable an adaptive inclination angle depending on the bending of the flexible lighting strip. A mechanical structure and positioning of the carrier structure may, for example, be adapted to the neutral plane of the flexible lighting strip during bending and the intended application. The LEDs may, for example, be mounted on carrier elements which are mechanically and electrically coupled by means of intermediate connection elements. Mechanical connection between the carrier elements and the connection elements may be arranged such that the angle of inclination of the carrier elements changes during bending. The mechanical connection between the carrier elements of the connection elements may be a kind of hinge. The hinge, carrier elements and/or connection elements may be arranged such that the angle of inclination increases with increasing curvature of the flexible lighting strip.

The carrier structure may comprise an anode track and a cathode track for supplying the LEDs with electrical power. The carrier structure may in one embodiment consist of the anode track and the cathode track. The anode track and the cathode track may in an alternative embodiment be part of the carrier elements or connection elements which comprise additional structural elements.

The light-emitting diodes may be embedded in a flexible translucent material. The translucent material may, for example, be a silicone polymer. The translucent material may be arranged to support light emission in a predefined direction during operation of the flexible lighting strip.

The translucent material may, for example, be comprised by a light guiding structure. The light guiding structure may be framed by a frame structure such that emitted light emitted by the LEDs during operation of the flexible lighting strip leaves the light guiding structure via an opening of the frame structure. The frame structure may be arranged to reflect and redistribute light guided within the light guiding structure. The frame structure may especially comprise reflective surfaces supporting light emission in the predefined direction during operation of the flexible lighting strip. The frame structure may comprise a flexible base and flexible side walls. Inclination of the LEDs may support guiding of the light emitted by the LEDs in the light guiding structure. The light guiding structure may comprise a three-dimensional structure which is arranged on or which is comprised by the light emission surface of the flexible lighting strip to couple out the light at a certain position under a certain angle. The light guiding structure may, for example, comprise a holographic structure. The holographic structure may be arranged to support emission of light in a predefined direction depending on a curvature of the light emission surface of the flexible lighting strip.

The flexible lighting strip may further comprise a diffusor. The diffusor is arranged to change a light distribution of light emitted by the LEDs during operation of the flexible lighting strip. The diffusor is arranged to at least partly mask positions of the LEDs. The diffusor may deteriorate the directionality of the light emitted by the LEDs. However, the closer the diffusor is placed to the LEDs the less directionality is deteriorated. The diffusor may be arranged to provide a directional light emission. The diffusor and or the light guiding structure may be arranged to guide light emitted by the LEDs and to couple out the guided light at predefined areas of the light emission surface. The diffusor may, for example, be arranged such that light outcoupling of light emitted by the LEDs is weighted in one direction of the longitudinal extension of the flexible lighting strip (e.g. forward or backward direction). The light guiding structure (see above) or the diffusor may be arranged to couple out majority of the guided light at a first side of the flexible lighting strip which is arranged to point, for example, in a forward direction of a DRL. The light outcoupling may decrease from the first side to the second side of the flexible lighting strip. The diffusor may be further arranged to provide a smooth brightness profile along the extension of the flexible lighting strip.

According to a further aspect a vehicle light assembly is provided. The vehicle light assembly comprises the flexible lighting strip according to any embodiment described above. The vehicle light assembly comprises an electrical interface. The electrical interface is arranged to couple the vehicle light assembly to an external power supply or control system.

A vehicle signaling light may comprise the vehicle light assembly or flexible lighting strip in accordance with any embodiment described above. The vehicle signaling light may further comprise an electrical driver to provide an electrical drive current for the LEDs. The electrical driver may receive electrical power and electrical control signals via the electrical interface The flexible lighting strip or the vehicle light assembly may, for example, be used in daytime running light (DRL), tail light, stop light or turn light.

It shall be understood that a preferred embodiment of the invention can also be any combination of the dependent claims with the respective independent claim.

Further advantageous embodiments are defined below.

BRIEF DESCRIPTION OF THE DRAWINGS

These and other aspects of the invention will be apparent from and elucidated with reference to the embodiments described hereinafter.

The invention will now be described, by way of example, based on embodiments with reference to the accompanying drawings.

In the drawings:

FIG. 1 shows a perspective view of a first flexible lighting strip

FIG. 2 shows a first cross section of a second flexible lighting strip

FIG. 3 shows a second cross section of a third flexible lighting strip

FIG. 4 shows a cross section of a vehicle signaling light

FIG. 5 shows a third cross section of a fifth flexible lighting strip

In the Figures, like numbers refer to like objects throughout. Objects in the FIGS. are not necessarily drawn to scale.

DETAILED DESCRIPTION OF THE PREFERRED EMBODIMENTS

Various embodiments of the invention will now be described by means of the Figures.

Figure 1:
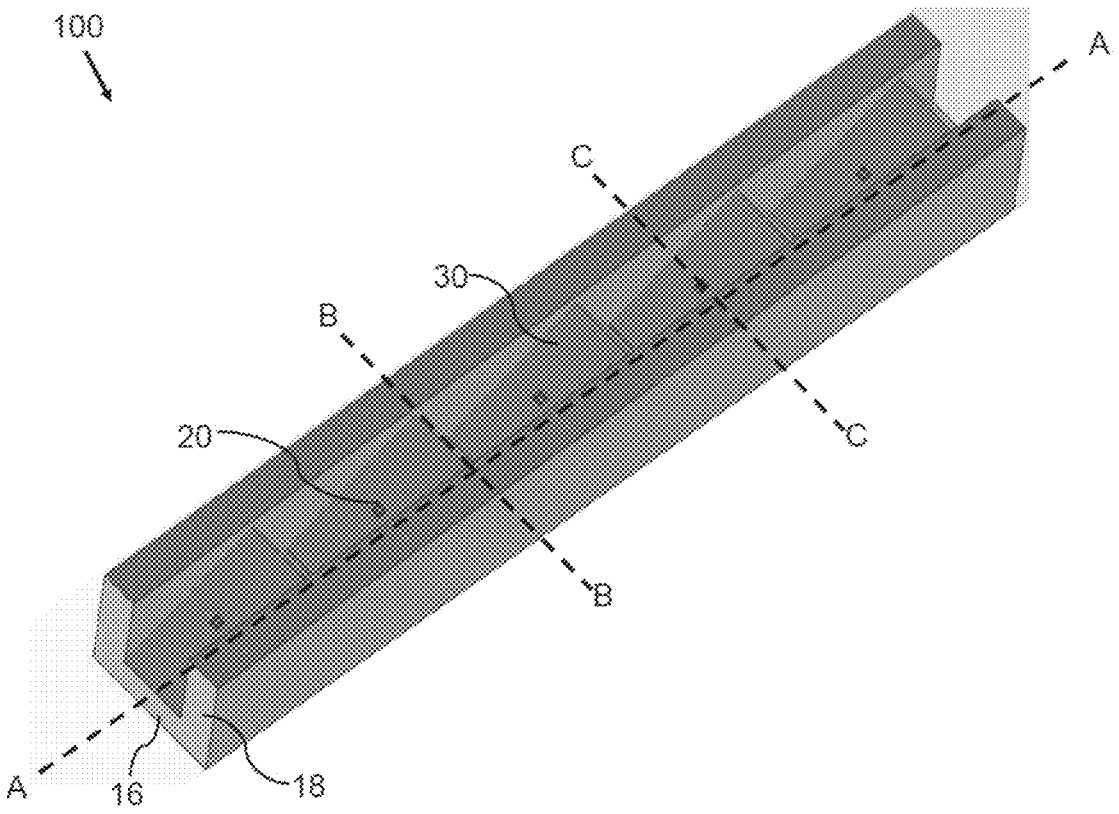
Figure 3:
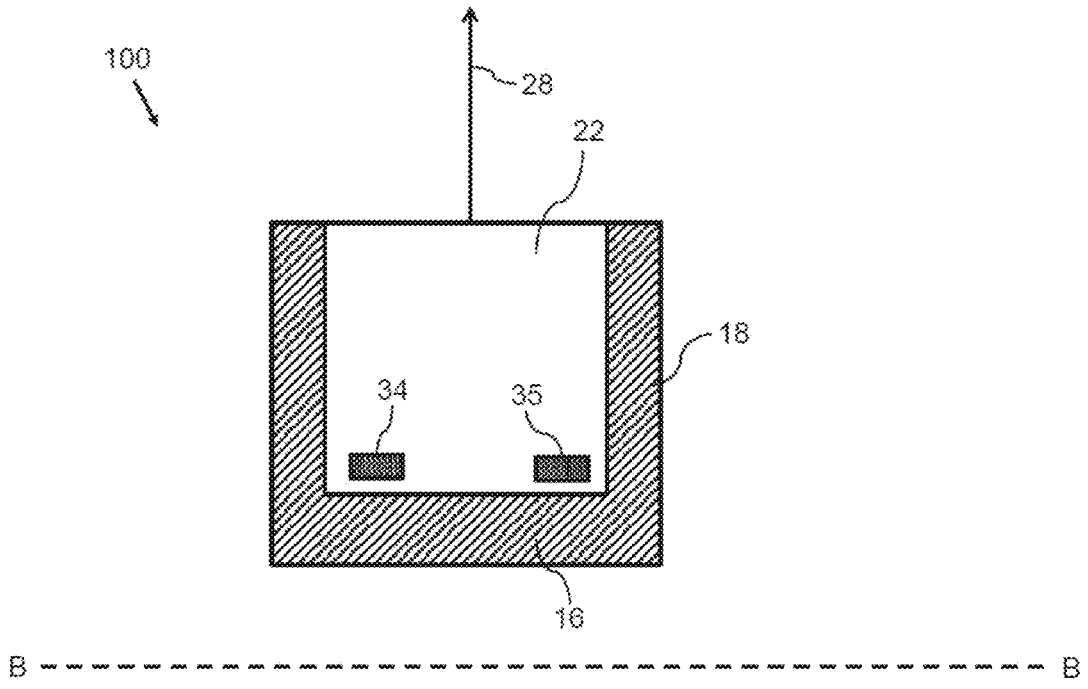

FIG. 1 shows a perspective view of a first flexible lighting strip 100. The flexible lighting strip 100 comprises a frame structure with a flexible base 16 and flexible side walls 18. LEDs 20 are mounted on a carrier structure 30. The carrier structure 30 is characterized by a saw tooth arrangement. The LEDs 20 are mounted on one side of the saw tooth arrangement such that all light exit surfaces of the LEDs 20 are inclined with respect to a surface normal of a light emission surface of the flexible lighting strip 100. The light emission surface is at the same level as the upper surface of the flexible side walls 18 as shown in FIG. 3. The light exit surfaces of the LEDs 20 point in the same direction.

Figure 2:
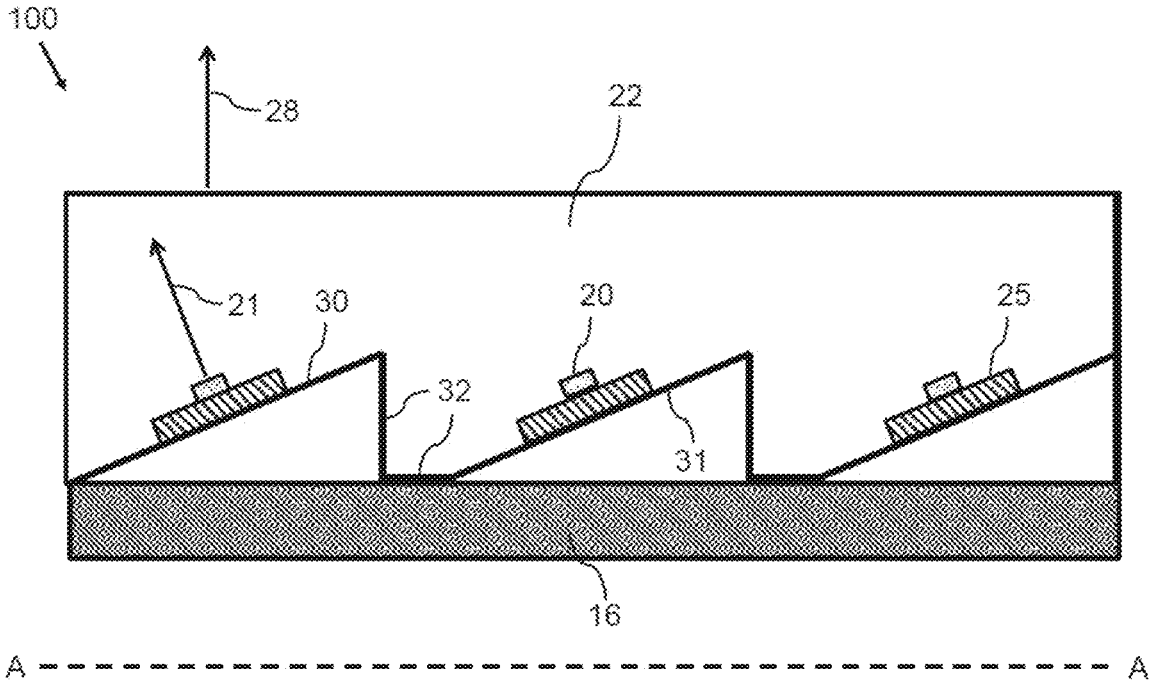

FIG. 2 shows a first cross section of a second flexible lighting strip 100 along the line A-A indicated in FIG. 1. Each LED 20 is mounted on a submount 25. The submounts 25 are mounted on a carrier structure 30. The carrier structure 30 comprises carrier elements 31 and connection elements 32. The LEDs 20 are mounted on the carrier elements 31 which are inclined with respect to a surface normal of a light emission surface 28 of the flexible lighting strip 100. The inclination of the carrier elements 31 and the corresponding inclination of light exit surfaces of the LEDs 20 do have the effect that an angle between a surface normal of the light exit surface 21 of one LED 20 enclose an angle of more than 0° with a corresponding surface normal of the light emission surface 28. Corresponding surface normal means the surface normal of the surface element of the light emission surface which is arranged directly above the LED 20. The surface normals of the light emission surface 28 point all in the same direction if the flexible lighting strip 100 is straight. The surface normals of the light emission surface 28 are directed in different directions if the flexible lighting strip 100 is bended. The carrier elements 31 are mechanically connected by connection elements 32. The carrier elements 31 and the connection elements 32 are arranged in saw tooth arrangement. The carrier structure 30 further comprises an anode track and a cathode track which are not shown in FIG. 2. The carrier structure 30, the submounts 25 and the LEDs 20 are embedded in a light guiding structure 22 which comprises a flexible translucent material (e.g. a silicone polymer).

FIG. 3 shows a second cross section of a third flexible lighting 100 strip along line B-B indicated in FIG. 1. The third flexible lighting strip 100 comprises a frame structure with a flexible base 16 and flexible side walls 18 (e.g. flexible plastic material or colored silicone) which enclose a flexible translucent material. The frame structure and the flexible translucent material built a light guiding structure 22. An opening of the frame structure which coincides with an upper surface of the flexible translucent material builds the light emission surface which is characterized by a surface normal of the light emission surface 28. FIG. 3 further shows a cross-section of a connection element of a carrier structure which consists in this embodiment of an anode track 34 and a cathode track 35 which are arranged to supply electrical power and electrical control signals to the LEDs 20.

Figure 4:
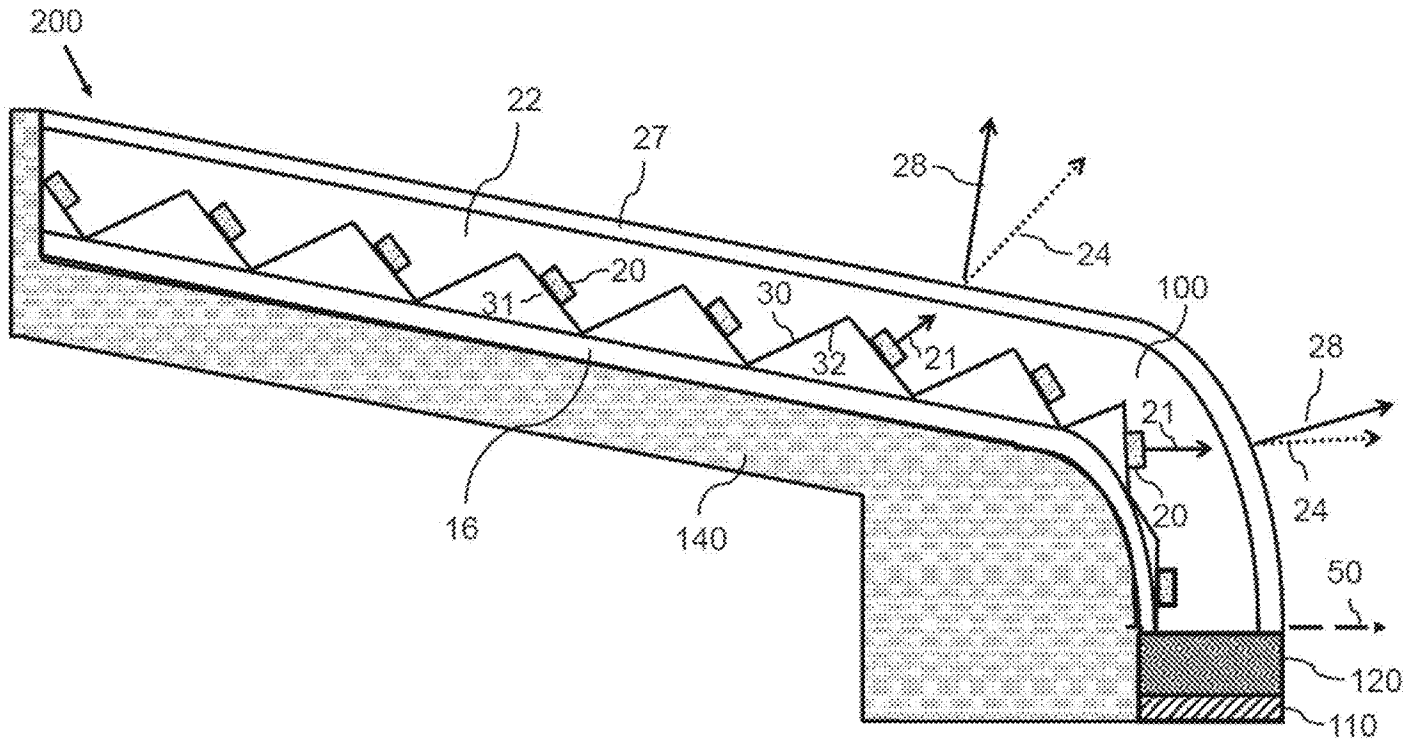

FIG. 4 shows a cross section of a vehicle signaling light 200. The vehicle signaling light 200 comprises a flexible lighting strip 100 similar as discussed with respect to FIG. 2. The vehicle signaling light 200 further comprises a strip holder 140 for mounting the flexible lighting strip, an electrical interface 110 for receiving electrical power and control signals and an electrical driver 120 for electrically driving LEDs 20. The LEDs 20 are in this embodiment arranged in four groups of LEDs 20. The first group of LEDs 20 comprising one LED 20 is arranged on the right side of FIG. 4. A surface normal of the light exit surface 21 LED 20 comprised by the first group of LEDs 20 is collinear with a forward direction 50 of the vehicle signaling light 200 which coincides with a corresponding (local) surface normal of a light emission surface 28 of the flexible lighting strip 100. The second group of LEDs comprises one LED 20 which is arranged next to the first group of LEDs 20 going from the right side to the left side in FIG. 4. The surface normal of the light exit surface 21 of the LED 20 comprised by the second group of LEDs 20 encloses a small angle with the corresponding local surface normal of the light emission surface 28. The small angle is essentially the same like the angle enclosed between the (local) light emission direction 24 (direction of the intensity maximum) and the surface normal of the light emission surface 28. The third group of LEDs comprises one LED 20 which is arranged next to the second group of LEDs 20 going from the right side to the left side in FIG. 4. The surface normal of the light exit surface 21 of the LED 20 comprised by the third group encloses a different angle with the corresponding (local) surface normal of the light emission surface 28 than the LED 20 comprised by the second group. The fourth group of LEDs 20 comprises six LEDs 20 which are arranged next to the third group of LEDs 20 going from the right side to the left side in FIG. 4. The surface normals of the light exit surface 21 of the LEDs 20 comprised by the fourth group enclose the same angle with the corresponding (local) surface normal of the light emission surface 28. The angle corresponding to the fourth group of LEDs 20 is bigger than the angle associated with the LED 20 comprised by the third of LEDs 20 group. The angle enclosed between the surface normals of the light exit surfaces 21 and the (local) surface normals of the light emission surface 28 increases from the second group, to the third group and finally to the fourth group of LEDs 20. The LEDs 20 are mounted on a carrier structure 30 which comprises carrier elements 31 and connection elements 32 similar as discussed with respect to FIG. 2. The carrier elements 31 and the connection elements 32 are arranged in a saw tooth arrangement. The carrier structure 30 is arranged within a light guiding structure 22 comprising a frame structure (only the flexible base 16 is shown in FIG. 4) and a translucent flexible material. The flexible lighting strip 100 further comprises a diffusor 27 which builds the light emission surface. The diffusor 27 is arranged to support directionality of the light emitted by the inclined light exit surfaces 21 of the LEDs 20. FIG. 4 shows the angles of inclination in the final bended configuration of the flexible lighting strip 100 when the flexible lighting strip 100 is mounted in the strip holder 140. The angles of inclination between the surface normals of the light exit surface 21 and the surface normals of the light emission surface 28 may be different before the flexible lighting strip is mounted in the strip holder 140. The flexible lighting strip may, for example, comprise two groups of LEDs with different angles of inclination before mounting the flexible lighting strip 100. The first group of LEDs 20 may consist of the first and the second LED 20 on the right side in FIG. 4. The second group of LEDs 20 may consist of the remaining LEDs 20. Bending of the flexible lighting strip 100 during mounting in the strip holder 140 may in this alternative embodiment cause the different angles of inclination of the second group of LEDs and the third group of LEDs discussed above. The flexible lighting strip 100 may be straight before mounting in the strip holder 140. In an alternative embodiment it may be curved to simplify mounting.

Figure 5:
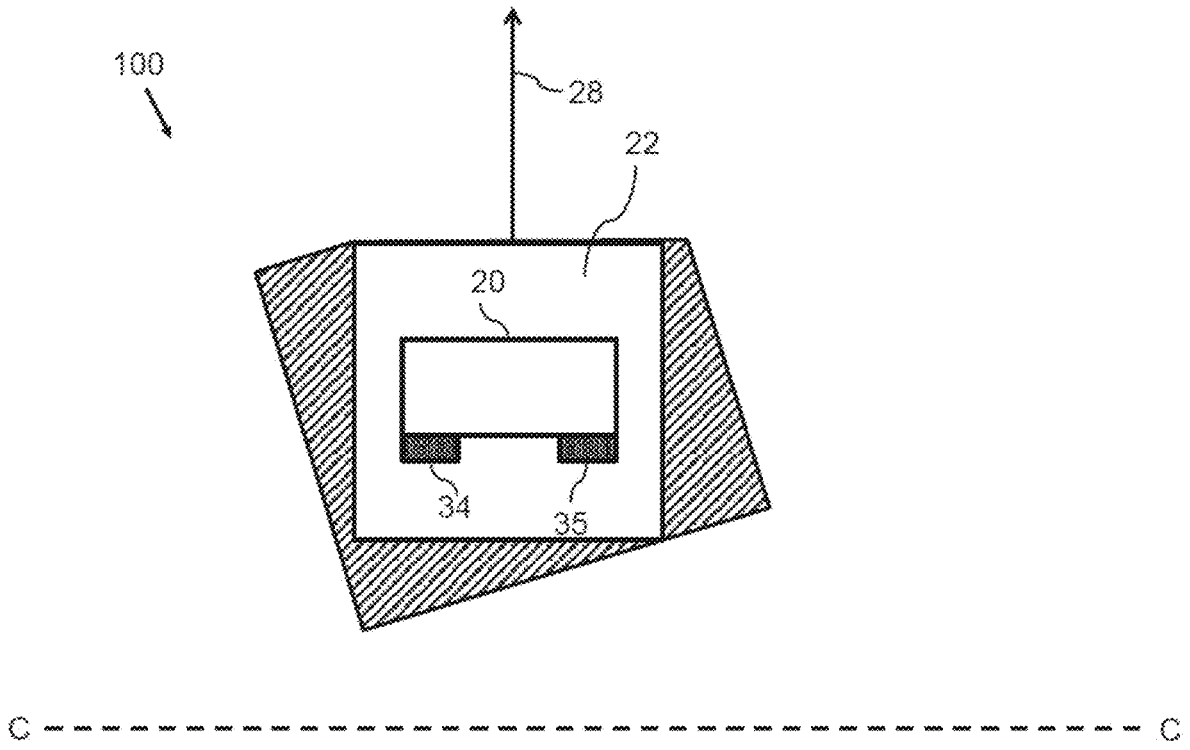

FIG. 5 shows a third cross section of a fifth flexible lighting strip 100 strip along line C-C indicated in FIG. 1. The fifth flexible lighting strip 100 comprises a flexible frame structure similar as discussed with respect to FIG. 3 which enclose a flexible translucent material. The frame structure and the flexible translucent material built a light guiding structure 22. An opening of the frame structure which coincides with an upper surface of the flexible translucent material builds the light emission surface which is characterized by a surface normal of the light emission surface 28. The shape of the frame structure and the orientation of the flexible translucent material within the frame structure are inclined with respect to each other such that the light emission surface 28 is inclined with respect to the outer shape of the frame structure. The relative arrangement of the light emission surface 28 with respect to the frame structure therefore enables a tailored direction of light emission in the direction of line C-C. FIG. 5 further shows a cross-section of a carrier element of a carrier structure which consists in this embodiment of an anode track 34 and a cathode track 35 which are arranged to supply electrical power and electrical control signals to the LEDs 20 which is mounted on the carrier element. The frame structure may, for example, alternatively have a circular cross-section in order to adapt orientation of the light emission surface 28 depending on the application. The light emission surface 28 may be planar as shown in FIGS. 3 and 5 or may, for example, be curved.

While the invention has been illustrated and described in detail in the drawings and the foregoing description, such illustration and description are to be considered illustrative or exemplary and not restrictive.

From reading the present disclosure, other modifications will be apparent to persons skilled in the art. Such modifications may involve other features which are already known in the art and which may be used instead of or in addition to features already described herein.

Variations to the disclosed embodiments can be understood and effected by those skilled in the art, from a study of the drawings, the disclosure and the appended claims. In the claims, the word "comprising" does not exclude other elements or steps, and the indefinite article "a" or "an" does not exclude a plurality of elements or steps. The mere fact that certain measures are recited in mutually different dependent claims does not indicate that a combination of these measures cannot be used to advantage.

Any reference signs in the claims should not be construed as limiting the scope thereof.

REFERENCE SIGNS

16 flexible base
18 flexible sidewalls
20 light-emitting diode (LED)
21 surface normal of light exit surface
22 light guiding structure
24 light emission direction
25 submount
27 diffusor
28 surface normal of light emission surface
30 carrier structure
31 carrier element
32 connection element
34 anode track
35 cathode track
50 forward direction
100 flexible lighting strip
110 electrical interface
120 electrical driver
140 strip holder
200 vehicle signaling light

What is claimed is:

1. A flexible lighting strip for use in a vehicle signaling light comprising:

a carrier structure including a surface having a plurality of connecting sections and plurality of mounting sections, the plurality of mounting sections being inclined relative to the plurality of connecting sections with an angle of the incline being more than 0° and increasing with increasing curvature of the surface of the carrier structure; and a plurality of light emitting diodes (LEDs) mounted on the mounting sections of the carrier structure, the plurality of LEDs including a first group of the plurality of LEDs having a light emission angle based on the angle of the incline.

2. The flexible lighting strip according to claim 1, further comprising a second group of the plurality of LEDs mounted on the surface of the carrier structure, the second group of the plurality of LEDs corresponding to a second group of mounting sections at a second angle of the surface and having a light emission angle based on the angle of the incline and wherein the second angle is different than the angle.

3. The flexible lighting strip according claim 2, further comprising a third group of the plurality of LEDs mounted on the surface of the carrier structure, the third group of the plurality of LEDs corresponding to a third group of mounting sections at different angles of the surface and having a light emission angle based on the angle of the incline, and the different angles change along a longitudinal extension of the flexible lighting strip.

4. The flexible lighting strip according to claim 1, the carrier structure further comprising carrier elements and connection elements in an alternating arrangement, and the carrier elements are inclined with respect to the connection elements.

5. The flexible lighting strip according to claim 4, wherein the carrier elements and the connection elements are arranged in a saw tooth arrangement.

6. The flexible lighting strip according to claim 1, the carrier structure further comprising an anode track and a cathode track for supplying electrical power to the plurality of light-emitting diodes.

7. The flexible lighting strip according to claim 1, wherein the light-emitting diodes are embedded in a flexible translucent material.

8. The flexible lighting strip according to claim 7, wherein the translucent material is comprised by a light guiding structure, and wherein the light guiding structure is framed by a frame structure such that light emitted by the light-emitting diodes during operation of the flexible lighting strip leaves the light guiding structure via an opening of the frame structure.

9. The flexible lighting strip according to claim 1, further comprising a diffusor, wherein the diffusor is arranged to change a light distribution of light emitted by the light-emitting diodes during operation of the flexible lighting strip.

10. The flexible lighting strip according to claim 9, wherein the diffusor is arranged such that light outcoupling of light emitted by the light-emitting diodes is weighted in a direction perpendicular to the surface normal of the light emission surface of the flexible lighting strip.

11. The flexible lighting strip according to claim 1, wherein the carrier structure is capable of bending in at least two linear independent axes.

12. The flexible lighting strip according to claim 1, wherein the carrier structure is capable of bending in at least three linear independent axes.

13. The flexible lighting strip according to claim 1, wherein the surface of the carrier structure comprises a flexible base structure.

* * * * *